US009673496B2

(12) United States Patent
Hirayama

(10) Patent No.: US 9,673,496 B2
(45) Date of Patent: Jun. 6, 2017

(54) SIGNAL TRANSMISSION LINE

(71) Applicant: Sumitomo Electric Device Innovations, Inc., Yokohama-shi (JP)

(72) Inventor: Masahiro Hirayama, Yokohama (JP)

(73) Assignee: Sumitomo Electric Device Innovations, Inc., Yokohoma-shi (JP)

( * ) Notice: Subject to any disclaimer, the term of this patent is extended or adjusted under 35 U.S.C. 154(b) by 52 days.

(21) Appl. No.: 14/491,236

(22) Filed: Sep. 19, 2014

(65) Prior Publication Data

US 2015/0084714 A1 Mar. 26, 2015

(30) Foreign Application Priority Data

Sep. 20, 2013 (JP) ..... 2013-195633

(51) Int. Cl.
*H01P 1/20* (2006.01)
*H01P 3/08* (2006.01)
*H01P 1/203* (2006.01)

(52) U.S. Cl.
CPC ..... *H01P 1/2007* (2013.01); *H01P 3/081* (2013.01); *H01P 1/203* (2013.01)

(58) Field of Classification Search
CPC .. H01P 3/08; H01P 3/081; H01P 1/203; H01P 1/2007
USPC ..... 333/33, 204, 238, 246
See application file for complete search history.

(56) References Cited

U.S. PATENT DOCUMENTS 6,467,152 B1 * 10/2002 De Los Santos ..... H01P 5/107 216/24
2010/0060388 A1 * 3/2010 Ueda ..... H01P 1/203 333/236
2013/0321093 A1 * 12/2013 Ueda ..... H01P 1/32 333/17.3

FOREIGN PATENT DOCUMENTS

JP 2005-252251 9/2005

* cited by examiner

*Primary Examiner* — Benny Lee
*Assistant Examiner* — Jorge Salazar, Jr.
(74) *Attorney, Agent, or Firm* — Venable LLP; Michael A. Sartori; Laura G. Remus

(57) ABSTRACT

A signal transmission line is disclosed. The signal transmission line includes a dielectric substrate, a signal line formed on a first surface of the dielectric substrate, a first conductive layer formed on a second surface of the dielectric substrate, and a first stub formed on the first surface of the dielectric substrate, the first stub being electrically connected with the signal line. The first stub includes a plurality of straight areas each extending from a different position of the signal line, a conductor part extending in parallel with the signal line, the conductor part being electrically connected with straight areas, a projection part connected with the conductor part, the projection part extending from the conductor part, and an opening provided between the conductor part and the signal line.

20 Claims, 8 Drawing Sheets

SIGNAL TRANSMISSION LINE

FIELD

The present invention relates to a signal transmission line, and relates to a signal transmission line having a signal line, for example.

BACKGROUND

For an optical module for high-speed optical communication or the like, an optical modulator that modulates signal light is used. The optical modulator modulates intensity of optical signals outputted according to electric input signals. For example, in Japanese Patent Application Laid-Open Publication No. 2005-252251, an optical modulation device using an EA (Electro-Absorption) optical modulator is described. The optical modulator modulates the intensity of continuous light on the basis of inputted modulation signals. The modulation signals reach 10-40 GHz or higher. Therefore, for transmission of the modulation signals, design in consideration of high frequency transmission is carried out.

SUMMARY

Modulation signals of an optical modulator reach 10-40 GHz or higher. Therefore, for transmission of the modulation signals, design in consideration of high frequency transmission is carried out. For example, in the above-described optical modulation device, the modulation signals are inputted through a transmission line to the optical modulator. However, in the transmission line, when a stub of a large area is formed in order to obtain large reactance, a dip is sometimes generated in frequency characteristics.

An aspect of the present invention is a signal transmission line comprising: a dielectric substrate; a signal line formed on a first surface of the dielectric substrate; a first conductive layer formed on a second surface of the dielectric substrate; and a first stub formed on the first surface of the dielectric substrate, the first stub being electrically connected with the signal line, wherein the first stub includes a plurality of straight areas each extending from a different position of the signal line, a conductor part extending in parallel with the signal line, the conductive part being electrically connected with the plurality of straight areas, a projection part connected with the conductor part, the projection part extending from the conductor part, and an opening provided between the conductor part and the signal line.

DETAILED DESCRIPTION

[Description of Embodiments]

Figure 1:
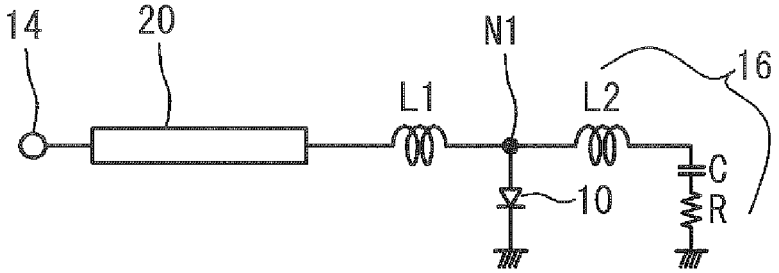
FIG. 1 is a circuit diagram of an optical component including a signal transmission line according to embodiment 1.

First of all, embodiments of the invention of the subject application will be described as enumerated below.

One embodiment of the present invention is a signal transmission line comprising: a dielectric substrate; a signal line formed on a first surface of the dielectric substrate; a first conductive layer formed on a second surface of the dielectric substrate; and a first stub formed on the first surface of the dielectric substrate, the first stub being electrically connected with the signal line, wherein the first stub includes a plurality of straight areas each extending from a different position of the signal line, a conductor part extending in parallel with the signal line, the conductive part being electrically connected with the plurality of straight areas, a projection part connected with the conductor part, the projection part extending from the conductor part, and an opening provided between the conductor part and the signal line.

According to one embodiment of the present invention, a suppression of a dip due to a stub and a miniaturization of a reactance circuit can be achieved.

In the above-described configuration, the signal transmission line may further comprise a second conductive layer connected with the first conductive layer, the second conductive layer being arranged in parallel with the conductor part and being provided on the first surface of the dielectric substrate.

In the above-described configuration, the first stub may include a plurality of the openings.

In the above-described configuration, the signal transmission line may further comprise a second stub provided on the first surface of the dielectric substrate, wherein the first stub and the second stub are respectively located at either side of the signal line.

In the above-described configuration, the signal transmission line may further comprise a third conductive layer provided on a side face of the dielectric substrate, the third conductive layer being connected with the first conductive layer and the second conductive layer.

In the above-described configuration, the signal line, the first conductive layer, and the first stub may be made of a metal, and the dielectric substrate may be made of an aluminum oxide.

In the above-described configuration, the second conductive layer may be made of a metal, and the dielectric substrate may be made of an aluminum oxide.

In the above-described configuration, the second stub may be made of a metal, and the dielectric substrate may be made of an aluminum oxide.

In the above-described configuration, the third conductive layer may be made of a metal, and the dielectric substrate may be made of an aluminum oxide.

In the above-described configuration, the metal may be gold or copper.

In the above-described configuration, an electrical length of the first stub may be smaller than λ/4.

[Details of Embodiments]

Specific examples of the signal transmission line according to embodiments of the present invention will be described below with reference to the accompanying drawings. It should be noted that the present invention is not limited to these examples but shown in the claims, and it is intended that all modifications that come within the meaning and range of equivalence to the claims should be embraced herein. In the description, the same elements or elements having the same function are denoted with the same reference signs, and an overlapping description will be omitted.

[Embodiment 1]

FIG. 1 is a circuit diagram of an optical component including a signal transmission line according to embodiment 1. As illustrated in FIG. 1, an input terminal 14 is electrically connected through a signal transmission line 20 and an inductor L1 to a node N1. An anode of an optical modulator 10 is electrically connected to the node N1 and a cathode of the optical modulator 10 is grounded. The node N1 is grounded through an inductor L2, a capacitor C and a resistance R in series. The inductor L2, the capacitor C and the resistor R form an impedance matching circuit 16. The impedance matching circuit 16 matches terminal impedance of the optical modulator 10 to 50Ω for example. In this case, for example, a resistance value of the resistor R is set to the same 50Ω as the terminal impedance.

The inductors L1 and L2 are, for example, bonding wires. The capacitor C is a chip capacitor for example, and the resistor R is a chip resistor for example. The optical modulator 10 is an EA optical modulator for example. To the input terminal 14, high frequency signals outputted by a modulation drive IC (Integrated Circuit) are inputted for example.

Figure 2A:
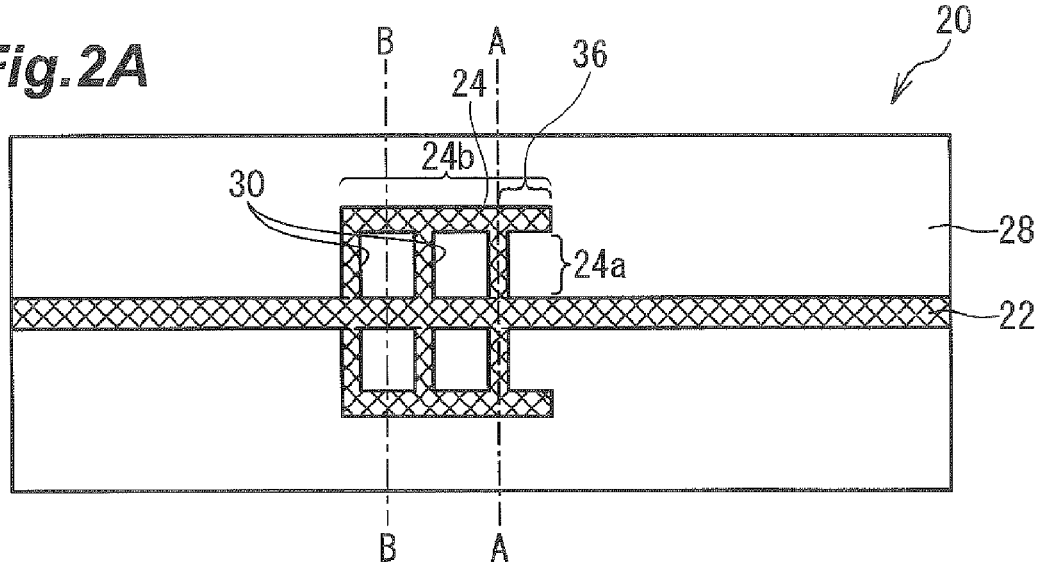
FIG. 2A is a plan view of the signal transmission line according to embodiment 1.
Figure 2B:
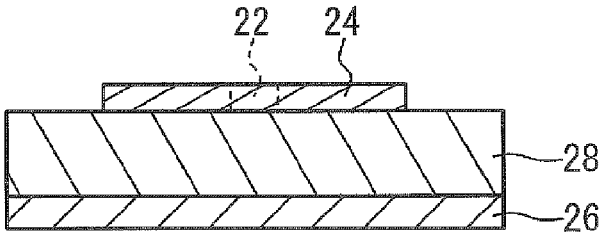
FIG. 2B and FIG. 2C are an A-A line end view and a B-B line end view of FIG. 2A respectively.
Figure 2C:
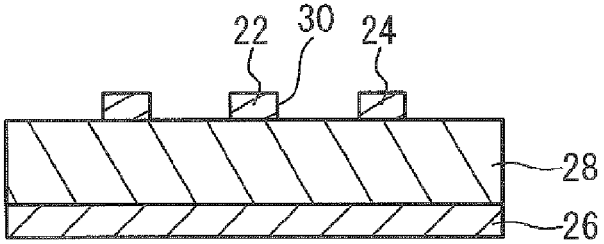

FIG. 2A is a plan view of the signal transmission line according to embodiment 1, and FIG. 2B and FIG. 2C are an A-A line end view and a B-B line end view of FIG. 2A, respectively. As illustrated in FIG. 2A to FIG. 2C, the signal transmission line 20 transmits high frequency signals inputted to the optical modulator 10. The signal transmission line 20 includes a dielectric substrate 28, a signal line 22, a stub 24, and a conductive layer (first conductive layer) 26. The dielectric substrate 28 is formed of a dielectric of aluminum oxide or the like for example. The signal line 22 is formed on the upper surface of the dielectric substrate 28. For example, the signal line 22 extends from one end to the other end of the dielectric substrate 28 along with the extending direction thereof.

The stub 24 is formed on the upper surface of the dielectric substrate 28, and extends from the signal line 22. That is, the stub 24 is provided in contact with the signal line 22. The stub 24 includes openings 30 and a projection 36. The projection 36 is, for example, provided along the extending direction of the signal line 22. The stub 24 is formed to include a plurality of straight areas 24*a* extending in a direction intersecting with the extending direction of the signal line 22, and a straight area 24*b* (conductor part) extending in parallel with the signal line 22. The projection 36 may be formed as a part of the straight area 24*b*.

The conductive layer 26 is formed to cover the lower surface of the dielectric substrate 28. The conductive layer 26 has a reference potential of the ground or the like. The signal line 22 and the conductive layer 26 form a microstrip line. The signal line 22, the stub 24, and the conductive layer 26 are formed of a metal such as gold (Au) or copper (Cu) for example.

Figure 3A:
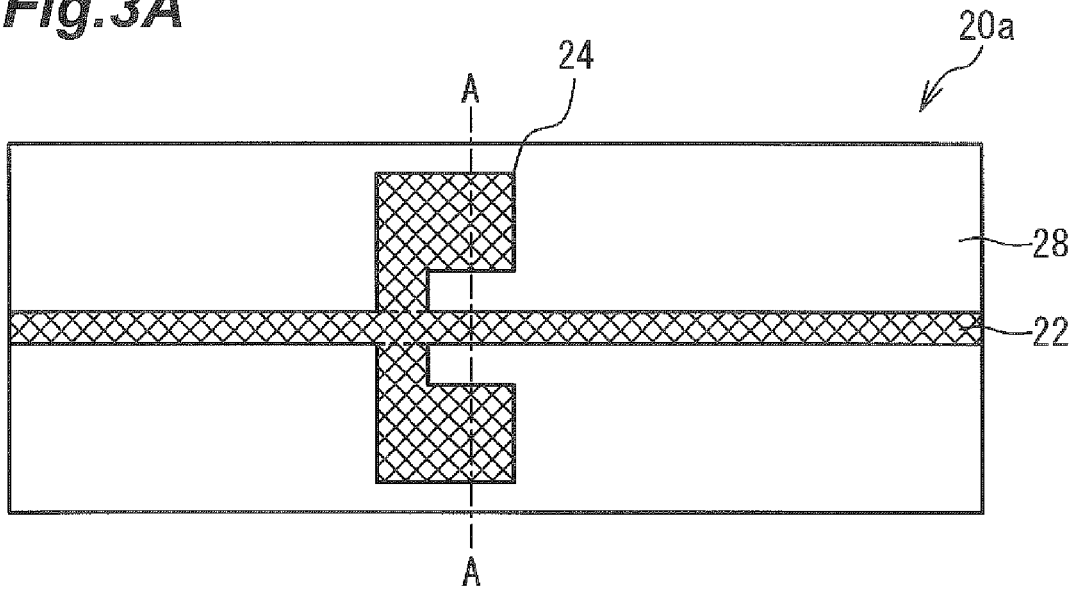
FIG. 3A is a plan view of a signal transmission line according comparative example 1.
Figure 3B:
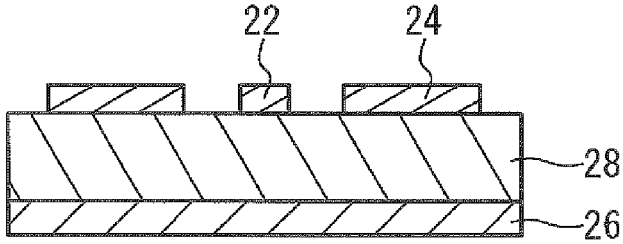
FIG. 3B is an A-A line end view of FIG. 3A.

Next, comparative example 1 to be compared with embodiment 1 will be described. FIG. 3A is a plan view of a signal transmission line according to comparative example 1, and FIG. 3B is an A-A line end view of FIG. 3A. As illustrated in FIG. 3A and FIG. 3B, the stub 24 of a signal transmission line 20*a* according to comparative example 1 does not include an opening Other components are the same as those in embodiment 1 and descriptions thereof are omitted.

Figure 4A:
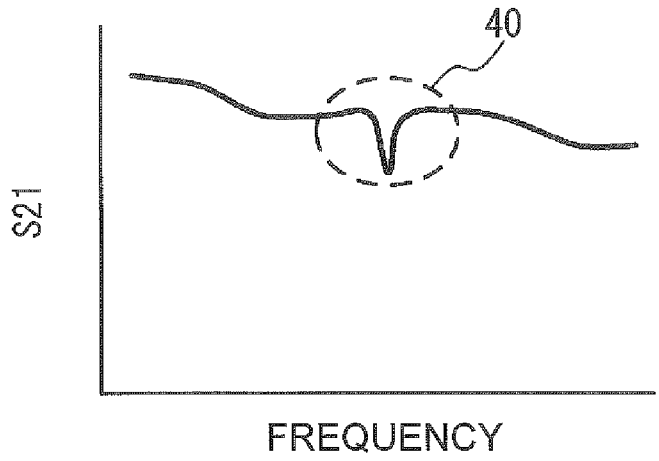
FIG. 4A and FIG. 4B are diagrams schematically illustrating a pass characteristic (S21) to a frequency of transmission signals respectively in comparative example 1 and embodiment 1.
Figure 4B:
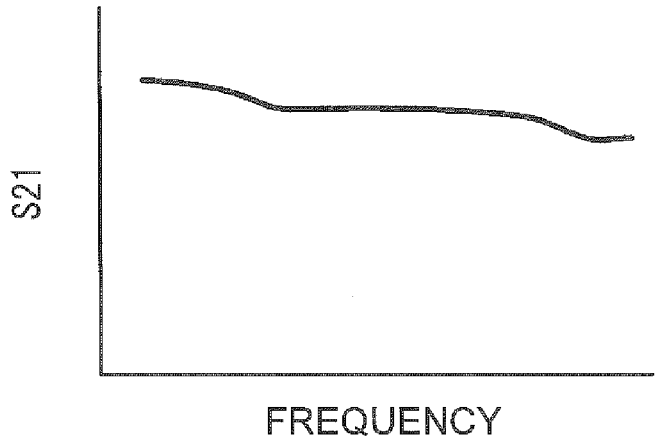

FIG. 4A and FIG. 4B are diagrams schematically illustrating a pass characteristic (S21) to a frequency of transmission signals respectively in comparative example 1 and embodiment 1. As illustrated in FIG. 4A, in comparative example 1, a dip 40 is generated in the pass characteristic of the transmission signals. As illustrated in FIG. 4B, in embodiment 1, a dip is not generated in the pass characteristic of the transmission signals.

Figure 5:
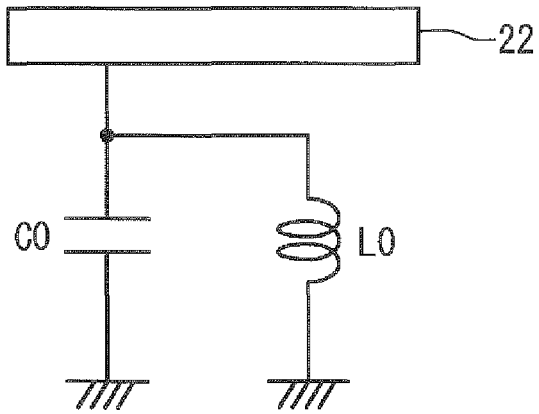
FIG. 5 is a diagram illustrating an equivalent circuit in comparative example 1.

FIG. 5 is a diagram illustrating an equivalent circuit in comparative example 1. As illustrated in FIG. 5, a capacitance component C0 and an inductance component L0 are connected in parallel between the signal line 22 and the reference potential. The capacitance component C0 corresponds to a capacitance component formed in a small area inside the stub 24. The inductance component L0 is an element of inductance generated by area enlargement of the stub 24. The inductance component L0 enters the state of being connected in parallel with the capacitance component per unit area within a plane of the stub 24. In order to enlarge the reactance component of the signal transmission line 20*a*, the area of the stub 24 is enlarged. Then, the element of the inductance component L0 increases in addition to the capacitance component C0. Therefore, an antiresonant circuit by the equivalent circuit illustrated in FIG. 5 is formed. By an antiresonant point of the antiresonant circuit, the dip 40 is formed as illustrated in FIG. 4A.

In embodiment 1, the plurality of straight areas 24*a* respectively extend from a plurality of positions of the signal line 22, and distal ends of the individual straight areas 24*a* are electrically connected in common by the straight area 24*b* (conductor part) arranged in parallel with the signal line 22. Thus, the stub 24 is provided with the openings 30 between the straight area 24*b* and the signal line 22.

In this way, since the stub 24 includes the openings 30, the element of the inductance component L0 generated by enlargement of the stub 24 can be reduced. Thus, the generation of the dip 40 can be suppressed.

The stub 24 may include one opening 30 but the stub 24 may also include a plurality of openings 30. Thus, the element of the inductance component L0 of the stub 24 can be suppressed more and the dip 40 can be suppressed more. Sizes and shapes of the plurality of openings 30 are the same, for example.

The stub 24 may be provided on one side of the signal line 22, but may also be arranged in the areas on both sides of the signal line 22. Thus, the reactance component of the signal transmission line 20 can be increased more. The plurality of stubs 24 may be provided along the extending direction of the signal line 22.

Also, in the case that the openings 30 are formed such that a width of the signal line 22 does not change, characteristic impedance of the signal transmission line 20 can be fixed.

Further, by the projection 36, the size of the reactance component formed by the stub 24 can be finely adjusted.

When a wavelength of high frequency signals transmitted through the signal transmission line 20 is defined as λ, the electric length of the stub 24 may be equal to or smaller than about λ/4. Therefore, the electric length of the stub 24 may be, for example, equal to or larger than λ/10 and equal to or smaller than λ/4. Note that the electric length of the stub 24 may correspond to the sum of a length of a straight area 24*a* and a width of the straight area 24*b*.

[Embodiment 2]

Figure 6A:
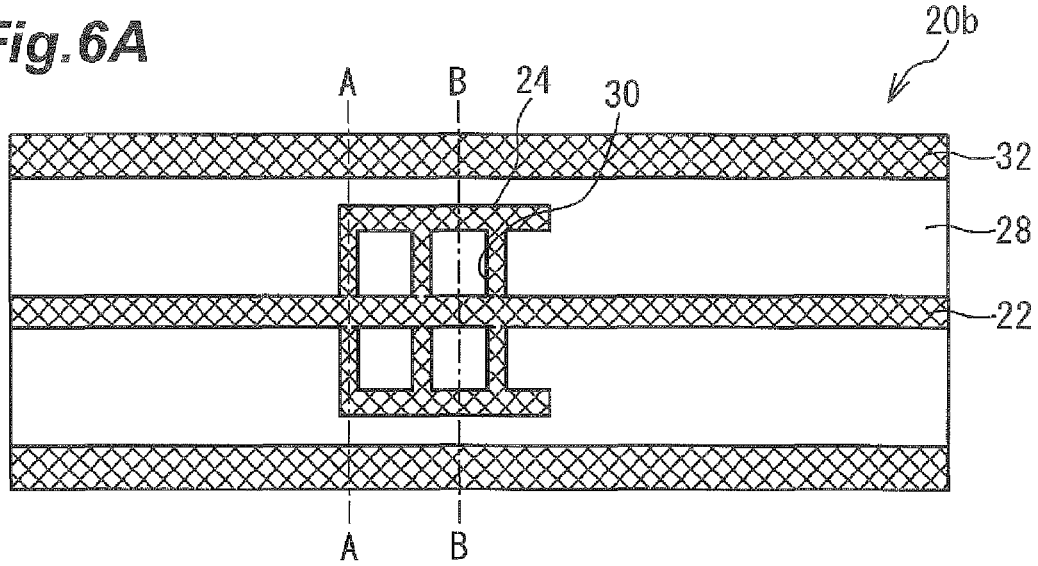
FIG. 6A is a plan view of a signal transmission line according to embodiment 2.
Figure 6B:
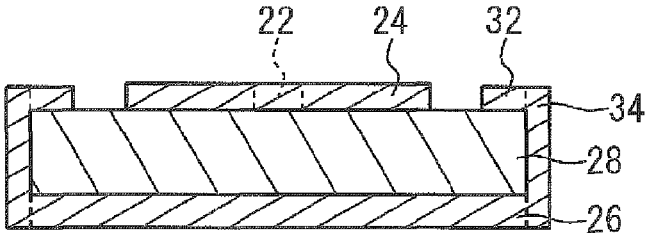
FIG. 6B and FIG. 6C are an A-A line end view and a B-B line end view of FIG. 6A respectively.
Figure 6C:
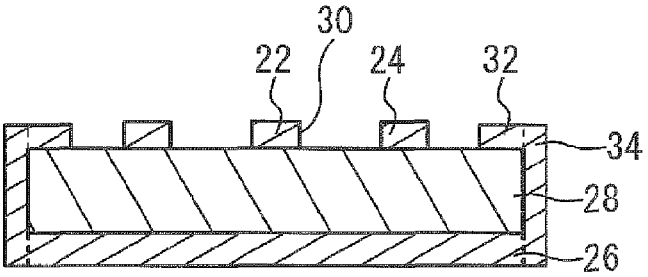

FIG. 6A is a plan view of a signal transmission line according to embodiment 2, and FIG. 6B and FIG. 6C are an A-A line end view and a B-B line end view of FIG. 6A, respectively. As illustrated in FIG. 6A to FIG. 6C, a conductive layer 32 (second conductive layer) extending in parallel with the straight area 24*b* on the outer side of the stub 24 is arranged on the upper surface of the dielectric substrate 28. Further, on a side face of the dielectric substrate 28, a conductive layer 34 (third conductive layer) is formed. The conductive layers 32 and 34 are made of a metal such as gold (Au) or copper (Cu) for example. Other components are the same as those in embodiment 1 and descriptions thereof are omitted.

Figure 7A:
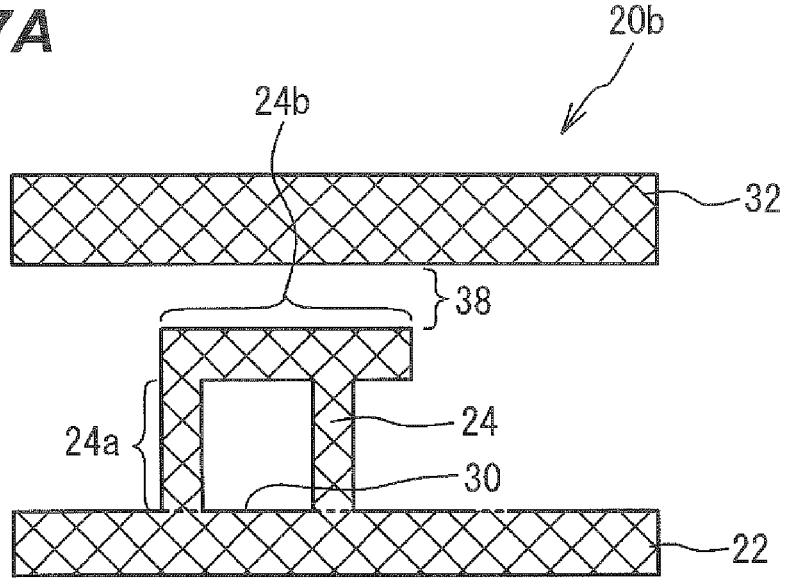
FIG. 7A is a plan view of the signal transmission line according to embodiment 2.
Figure 7B:
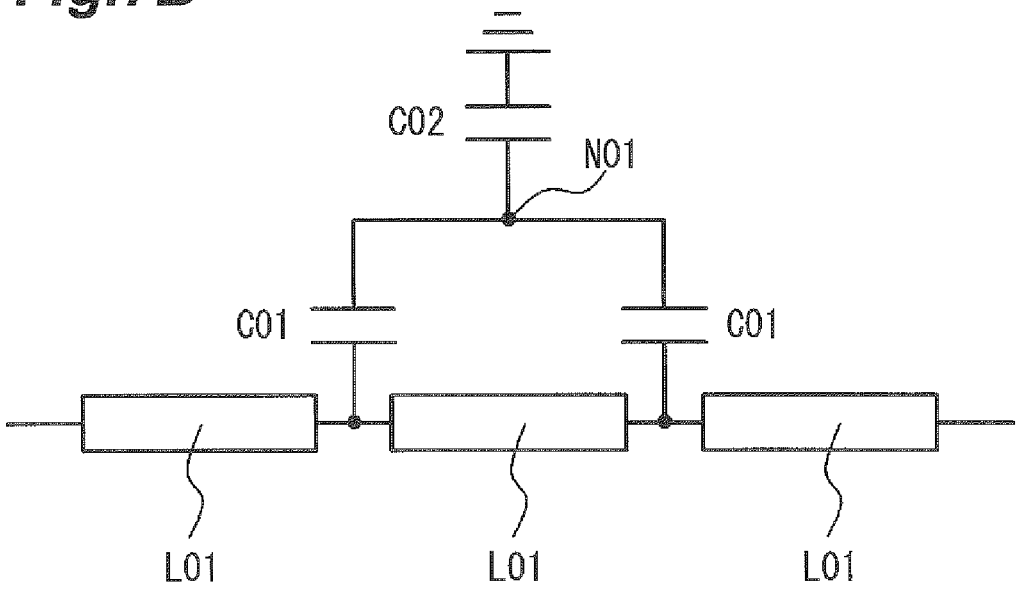
FIG. 7B is a diagram illustrating an equivalent circuit of FIG. 7A.

FIG. 7A is a plan view of the signal transmission line according to embodiment 2, and FIG. 7B is a diagram illustrating an equivalent circuit of FIG. 7A. In FIG. 7A, a part of a signal transmission line 20*b* is illustrated. As illustrated in FIG. 7B, one end of a plurality of capacitance components C01 is connected to a distributed constant line L01. The other end of the plurality of capacitance components C01 is connected in common to the node N1. One end of a capacitance component C02 is connected to a node N01. The other end of the capacitance component C02 is connected to the reference potential.

The signal line 22 in the signal transmission line 20*b* is indicated by the distributed constant line L01 in the equivalent circuit. In the stub 24 in the signal transmission line 20*b*, the straight area 24*a* extended to intersect with the signal line 22 is indicated by the capacitance component C01 in the equivalent circuit. The straight area 24*b* of the stub 24 in the signal transmission line 20*b* is indicated by the node N01 in the equivalent circuit. A space 38 between the stub 24 and the conductive layer 32 is indicated by the capacitance component C02 in the equivalent circuit.

According to embodiment 2, the conductive layer 32 connected with the reference potential is formed on the upper surface of the dielectric substrate 28 and on the outer side of the stub 24. Thus, as illustrated in FIG. 7B, the capacitance component C02 can be formed in addition to the capacitance component C01. Therefore, compared to embodiment 1, the stub 24 can be made small. For example, the electric length of the stub 24 can be made smaller than λ/4. Thus, the signal transmission line 20*b* can be miniaturized.

Further, the conductive layer 34 having the reference potential is formed on the side face of the dielectric substrate 28. Therefore, the capacitance component C02 can be enlarged more. Thus, the signal transmission line 20*b* can be miniaturized more.

Further, since the conductive layer 34 is in contact with the conductive layer 26 and the conductive layer 32, the conductive layers 26, 32 and 34 can be set to the same reference potential.

[Embodiment 3]

Figure 8A:
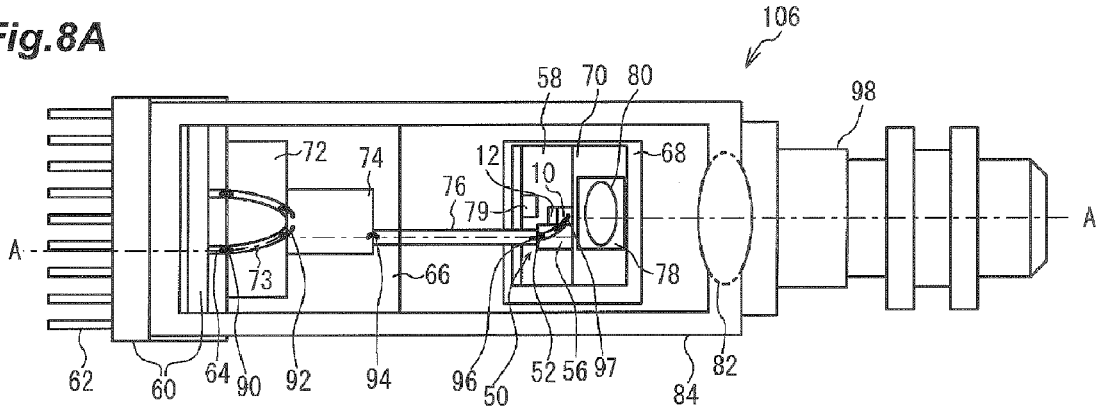
FIG. 8A is a top view of an optical modulation device according to embodiment 3 from which a cap is detached.
Figure 8B:
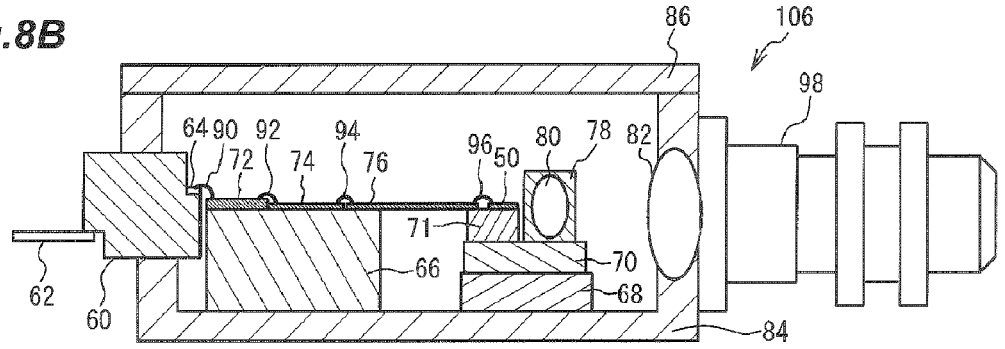
FIG. 8B is an A-A line cross-sectional view of FIG. 8A.

Embodiment 3 is an example of an optical modulation device including the signal transmission line according to embodiment 1 or embodiment 2. FIG. 8A is a top view of the optical modulation device according to embodiment 3 from which a cap is detached, and FIG. 8B is an A-A line cross-sectional view of FIG. 8A. For a receptacle 98, not a cross section but a side face is illustrated. As illustrated in FIG. 8A and FIG. 8B, in an optical modulation device 106, inside a housing 84, the optical modulator 10, a semiconductor laser 12, a modulation drive IC 74 (modulation driver) and the like are housed. Here, the optical modulator 10 and the semiconductor laser 12 are integrated into one chip. Also, interconnections/wires or the like connected to the semiconductor laser 12 are omitted.

The housing 84 is composed of a metal or the like for example. On a bottom surface of the housing 84, a TEC (Thermoelectric Cooler) 68 is arranged. On the TEC 68, a carrier 70 that is formed of insulation of aluminum oxide or ceramic or the like for example and has high heat conductivity is arranged. On the carrier 70, a sub carrier 71 and a lens holder 78 are arranged.

On the sub carrier 71, a dielectric substrate 50, the chip in which the optical modulator 10 and the semiconductor laser 12 are integrated, and a photodetector 79 are arranged. By the lens holder 78, a lens 80 is held. On an upper surface of the dielectric substrate 50, a signal line 52 is formed.

Further, on the bottom surface of the housing 84, a heat sink 66 composed of a metal such as copper tungsten (CuW) or copper molybdenum (CuMo) is arranged. On the heat sink 66, the modulation drive IC 74 and a substrate 72 having a transmission line 73 are arranged. An upper surface of the heat sink 66 and an upper surface of the sub carrier 71 are at the almost same height. A bridge 76 bridged between the upper surface of the heat sink 66 and the upper surface of the sub carrier 71 corresponds to the signal transmission line 20 or 20*b* according to embodiment 1 or embodiment 2.

On a front sidewall of the housing 84, a lens 82 is held. Further, to a front surface of the housing 84, the receptacle 98 is fixed. In a rear sidewall of the housing 84, a feed-through 60 mainly composed of an insulator is embedded. Inside the feed-through 60, an interconnection that electrically connects a terminal 64 inside the housing 84 and a terminal 62 outside the housing 84 is provided.

The terminal 64 and the transmission line 73 of the substrate 72 are electrically connected by a bonding wire 90. The transmission line 73 and the modulation drive IC 74 are electrically connected by a bonding wire 92. The modulation drive IC 74 and the signal line 22 inside the bridge 76 are electrically connected by a bonding wire 94. The signal line 22 inside the bridge 76 and the signal line 52 on the dielectric substrate 50 are electrically connected by a bonding wire 96.

Input signals which are high frequency signals are inputted from the terminal 62, through the interconnection inside the feed-through 60, the terminal 64, the bonding wire 90, the transmission line 73 and the bonding wire 92 to the modulation drive IC 74. The modulation drive IC 74 amplifies the input signals and outputs them as modulation electric signals. The outputted modulation electric signals are inputted through an output terminal of the modulation drive IC 74 and through the bonding wire 94, the signal line 22 inside the bridge 76 and the bonding wire 96 to the signal line 52. The signal line 52 is electrically connected with an electrode of the optical modulator 10 through a bonding wire 97. Thus, the modulation electric signals are inputted to the electrode of the optical modulator 10. The optical modulator 10 modulates the intensity of output light of the semiconductor laser 12, and emits the light. In such a manner, the output terminal of the modulation drive IC 74 and the electrode of the optical modulator 10 are electrically connected with each other through the bridge 76, and the modulation electric signals outputted by the modulation drive IC 74 is inputted to the optical modulator 10. The optical modulator 10 and a fiber (not shown in the drawings) inserted in the receptacle 98 are optically coupled by the lenses 80 and 82. Thus, the light emitted from the optical modulator 10 is introduced into the fiber. The photodetector 79 detects the intensity of the light emitted from a back surface of the semiconductor laser 12. A control circuit not shown in the drawings executes feedback control to a current to be applied to the semiconductor laser 12 according to output of the photodetector 79. The TEC 68 keeps a temperature of the semiconductor laser 12 and the optical modulator 10 fixed. Thus, a wavelength of the light emitted from the optical modulator 10 is locked and the semiconductor laser 12 can be stably operated.

As in embodiment 3, as a first loading member, the sub carrier 71 is loaded with the optical modulator 10. As a second loading member, the heat sink 66 is loaded with the modulation drive IC 74. The modulation drive IC 74 functions as an amplifier that outputs high frequency signals to the signal transmission line 20 or 20*b*. The signal transmission line 20 or 20*b* is mechanically connected by a connection part (a first connection part) provided on the upper surface of the sub carrier 71 and a connection part (a second connection part) provided on the upper surface of the heat sink 66, and is provide so as to bridge the sub carrier 71 and the heat sink 66. Therefore, on the lower surface of the signal transmission line 20 or 20*b*, a space exists. In this way, the first loading member (the sub carrier 71) and the second loading member (the heat sink 66) are arranged separately across the space, and the dielectric substrate of the bridge 76 is bridged and arranged on the space between the first loading member (the sub carrier 71) and the second loading member (the heat sink 66).

According to embodiment 3, even when the stub 24 is formed in order to enlarge the reactance component of the signal transmission line 20 or 20*b* through which high frequency signals outputted by the modulation drive IC 74 are transmitted, the generation of a dip can be suppressed.

In embodiment 3, an example of the optical modulation device 106 using the bridge 76, the bridge 76 including the signal transmission line 20 or 20*b* and being provided on the first loading member and the second loading member, is described. The signal transmission line 20 or 20*b* may be used in devices other than the optical modulation device.

What is claimed is:

1. A signal transmission line comprising:
a dielectric substrate;
a signal line capable of passing direct current therethrough, the signal line being formed on a first surface of the dielectric substrate;
a first conductive layer formed on a second surface of the dielectric substrate; and
a first stub formed on the first surface of the dielectric substrate, the first stub being directly connected with the signal line,
wherein the first stub includes:
a plurality of straight areas each extending from a different position of the signal line;
a conductor part extending in parallel with the signal line, the conductive part being electrically connected with the plurality of straight areas;
a projection part connected with the conductor part, the projection part extending from the conductor part; and
a first opening provided between the conductor part and the signal line.

2. The signal transmission line according to claim 1, further comprising a second conductive layer connected with the first conductive layer, the second conductive layer being arranged in parallel with the conductor part and being provided on the first surface of the dielectric substrate.

3. The signal transmission line according to claim 2, further comprising a third conductive layer provided on a side face of the dielectric substrate, the third conductive layer being connected with the first conductive layer and the second conductive layer.

4. The signal transmission line according to claim 3,
wherein the third conductive layer is made of a metal, and
wherein the dielectric substrate is made of an aluminum oxide.

5. The signal transmission line according to claim 4,
wherein the metal is gold or copper.

6. The signal transmission line according to claim 2,
wherein the second conductive layer is made of a metal, and
wherein the dielectric substrate is made of an aluminum oxide.

7. The signal transmission line according to claim 6,
wherein the metal is gold or copper.

8. The signal transmission line according to claim 1,
wherein the first stub includes a second opening provided between the conductor part and the signal line.

9. The signal transmission line according to claim 1, further comprising a second stub provided on the first surface of the dielectric substrate,
wherein the first stub and the second stub are respectively located on opposite sides of the signal line.

10. The signal transmission line according to claim 9,
wherein the second stub is made of a metal, and
wherein the dielectric substrate is made of an aluminum oxide.

11. The signal transmission line according to claim 10,
wherein the metal is gold or copper.

12. The signal transmission line according to claim 1,
wherein the signal line, the first conductive layer, and the first stub are made of a metal, and
wherein the dielectric substrate is made of an aluminum oxide.

13. The signal transmission line according to claim 12,
wherein the metal is gold or copper.

14. The signal transmission line according to claim 1,
wherein, an electrical length of the first stub is smaller than $\lambda/4$.

15. A signal transmission line comprising:
a dielectric substrate;
a signal line formed from one pattern and on a first surface of the dielectric substrate;
a first conductive layer formed on a second surface of the dielectric substrate; and
a first stub formed on the first surface of the dielectric substrate, the first stub being directly connected with the signal line,
wherein the first stub includes:
a plurality of straight areas each extending from a different position of the signal line;
a conductor part extending in parallel with the signal line, the conductive part being electrically connected with the plurality of straight areas;
a projection part connected with the conductor part, the projection part extending from the conductor part; and
an opening provided between the conductor part and the signal line.

16. The signal transmission line according to claim 15, further comprising a second conductive layer connected with the first conductive layer, the second conductive layer being arranged in parallel with the conductor part and being provided on the first surface of the dielectric substrate.

17. The signal transmission line according to claim 16, further comprising a third conductive layer provided on a side face of the dielectric substrate, the third conductive layer being connected with the first conductive layer and the second conductive layer.

18. A signal transmission line comprising:

a dielectric substrate;

a signal line formed continuously on a first surface of the dielectric substrate;

a first conductive layer formed on a second surface of the dielectric substrate; and a first stub formed on the first surface of the dielectric substrate, the first stub being directly connected with the signal line, wherein the first stub includes:

a plurality of straight areas each extending from a different position of the signal line;

a conductor part extending in parallel with the signal line, the conductive part being electrically connected with the plurality of straight areas;

a projection part connected with the conductor part, the projection part extending from the conductor part; and an opening provided between the conductor part and the signal line.

19. The signal transmission line according to claim 18, further comprising a second conductive layer connected with the first conductive layer, the second conductive layer being arranged in parallel with the conductor part and being provided on the first surface of the dielectric substrate.

20. The signal transmission line according to claim 19, further comprising a third conductive layer provided on a side face of the dielectric substrate, the third conductive layer being connected with the first conductive layer and the second conductive layer.

* * * * *